US011761646B2

(12) United States Patent
Garg et al.

(10) Patent No.: US 11,761,646 B2
(45) Date of Patent: Sep. 19, 2023

(54) SYSTEMS AND METHODS FOR REHEAT CONTROL OF AN HVAC SYSTEM

(71) Applicant: Johnson Controls Technology Company, Auburn Hills, MI (US)

(72) Inventors: Karan Garg, Jagadhri (IN); Mujibul R. Mohammad, Kakinada (IN); Hambirarao S. Sawant, Belagavi (IN); Anand M. Dulange, Solapur (IN); Amit R. Chothave, Pune (IN); Anthony J. Reardon, Norman, OK (US)

(73) Assignee: JOHNSON CONTROLS TYCO IP HOLDINGS LLP, Milwaukee, WI (US)

( * ) Notice: Subject to any disclaimer, the term of this patent is extended or adjusted under 35 U.S.C. 154(b) by 32 days.

(21) Appl. No.: 17/152,541

(22) Filed: Jan. 19, 2021

(65) Prior Publication Data

US 2022/0228758 A1 Jul. 21, 2022

(51) Int. Cl.

| | |
|---|---|
| ***F24F 3/153*** | (2006.01) |
| ***F24F 11/77*** | (2018.01) |
| ***F24F 3/14*** | (2006.01) |
| *F24F 110/12* | (2018.01) |

(52) U.S. Cl.

CPC ..... *F24F 3/153* (2013.01); *F24F 11/77* (2018.01); *F24F 3/1429* (2013.01); *F24F 2110/12* (2018.01); *F25B 2339/04* (2013.01)

(58) Field of Classification Search

CPC . F24F 3/14; F24F 3/1429; F24F 3/153; F25B 2339/04

See application file for complete search history.

(56) References Cited

U.S. PATENT DOCUMENTS

| | | | | |
|---|---|---|---|---|
| 2,961,844 | A | 11/1960 | McGrath | |
| 3,402,564 | A * | 9/1968 | Nussbaum | F24F 3/153 62/196.2 |
| 6,826,921 | B1 * | 12/2004 | Uselton | F24F 3/153 62/176.5 |
| 7,770,405 | B1 | 8/2010 | Dillon | |
| 2012/0272669 | A1 * | 11/2012 | Blanton | F24F 3/153 62/89 |
| 2013/0283831 | A1 * | 10/2013 | Hua | F24F 3/153 62/115 |

(Continued)

OTHER PUBLICATIONS

What is the Sequence of Operation for Reheat/Dehumidification on Voyager II and Precedent Units?, Trane- Light Commercial Help Center, 2020, 2 pgs.

*Primary Examiner* — Eric S Ruppert
*Assistant Examiner* — Hans R Weiland
(74) *Attorney, Agent, or Firm* — Fletcher Yoder, PC

(57) ABSTRACT

A heating, ventilation, and air conditioning (HVAC) system includes a reheat valve configured to receive a refrigerant flow and regulate division of the refrigerant flow provided to a reheat coil and a condenser. The HVAC system also includes a condenser fan configured to draw a flow of outdoor air across the condenser and a controller communicatively coupled to the reheat valve and the condenser fan. The controller is configured to monitor a position of the reheat valve and to control operation of the condenser fan based on a correspondence between the position of the reheat valve and a threshold degree of opening.

20 Claims, 6 Drawing Sheets

(56) References Cited

U.S. PATENT DOCUMENTS

| | | | | |
|---|---|---|---|---|
| 2015/0013356 | A1* | 1/2015 | Karkhanis | F24F 3/153 62/90 |
| 2016/0209056 | A1* | 7/2016 | Hung | F24F 3/153 |
| 2016/0273815 | A1* | 9/2016 | Downie | F24F 3/153 |
| 2019/0024959 | A1* | 1/2019 | Goel | F25B 40/02 |
| 2019/0331380 | A1* | 10/2019 | Seiler | F25B 49/022 |
| 2020/0025396 | A1 | 1/2020 | Leon | |
| 2020/0309394 | A1* | 10/2020 | Blanton | F24F 3/153 |
| 2020/0370765 | A1* | 11/2020 | Knight | F24F 3/153 |

* cited by examiner

SYSTEMS AND METHODS FOR REHEAT CONTROL OF AN HVAC SYSTEM

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

A heating, ventilation, and/or air conditioning (HVAC) system may be used to thermally regulate an environment, such as a space within a building, home, or other structure. The HVAC system generally includes a vapor compression system having heat exchangers, such as a condenser and an evaporator, which transfer thermal energy between the HVAC system and the environment. In some cases, the HVAC system also includes a reheat coil, which, together with the evaporator, is positioned along an air flow path of the HVAC system. The evaporator and the reheat coil may operate concurrently to facilitate dehumidification and temperature regulation of an air flow traveling along the air flow path and entering a building serviced by the HVAC system. Accordingly, the HVAC system may facilitate supply of a temperature regulated and dehumidified air flow to the building.

SUMMARY

The present disclosure relates to a heating, ventilation, and air conditioning (HVAC) system that includes a reheat valve configured to receive a refrigerant flow and regulate division of the refrigerant flow provided to a reheat coil and a condenser. The HVAC system also includes a condenser fan configured to draw a flow of outdoor air across the condenser and a controller communicatively coupled to the reheat valve and the condenser fan. The controller is configured to monitor a position of the reheat valve and control operation of the condenser fan based on a correspondence between the position of the reheat valve and a threshold degree of opening.

The present disclosure also relates to a reheat control system for a heating, ventilation, and air conditioning (HVAC) system. The reheat control system includes a reheat valve configured to receive a refrigerant flow and regulate division of the refrigerant flow provided to a reheat coil and a condenser. The reheat control system also includes a controller configured to adjust a position of the reheat valve based on feedback from one or more sensors to achieve an operational parameter, to monitor the position of the reheat valve, and to control operation of a condenser fan of the condenser based on the position of the reheat valve relative to a threshold degree of opening.

The present disclosure also relates to a method for operating a heating, ventilation, and air conditioning (HVAC) system. The method includes adjusting, with a controller, a position of a reheat valve based on feedback from one or more sensors to control division of a refrigerant flow between a reheat coil and a condenser. The method also includes monitoring, with the controller, the position of the reheat valve to determine a degree of opening of the reheat valve. The method also includes blocking, with the controller, operation of a condenser fan of the condenser in response to a determination that the degree of opening of the reheat valve reaches or exceeds a threshold degree of opening.

DETAILED DESCRIPTION

Figure 1:
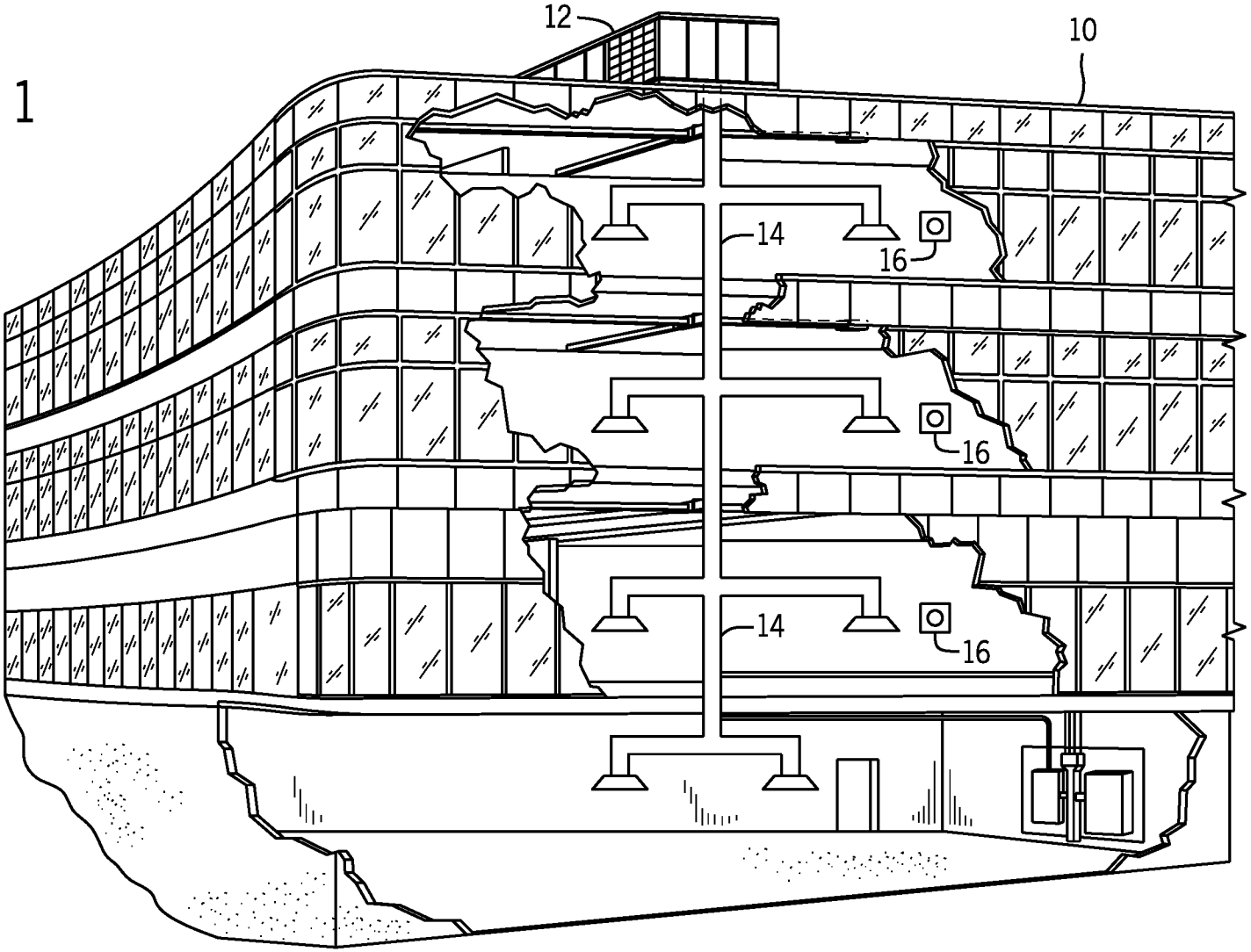
FIG. 1 is a perspective view of an embodiment of a building incorporating a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As briefly discussed above, a heating, ventilation, and/or air conditioning (HVAC) system may be used to thermally regulate a space within a building, home, or other suitable structure. For example, the HVAC system may include a vapor compression system that transfers thermal energy between a working fluid, such as a refrigerant, and a fluid to be conditioned, such as air. The vapor compression system includes a condenser and an evaporator that are fluidly coupled to one another via one or more conduits of a refrigerant loop. A compressor may be used to circulate the refrigerant through the conduits and other components of the refrigerant loop (e.g., an expander), thus, enabling the transfer of thermal energy between components of the refrigerant loop (e.g., between the condenser and the evaporator via the refrigerant) and between the refrigerant loop and supply air.

The evaporator may be positioned within an enclosure or housing of the HVAC system that defines an air flow path of the HVAC system. As discussed in detail below, the air flow path permits the HVAC system to supply a flow of conditioned air (e.g., cooled air, heated air, dehumidified air) to one or more rooms, zones, or other suitable spaces within a building or other structure serviced by the HVAC system. For example, a fan or blower may be positioned in the air flow path and used to draw a flow of supply air into the air flow path. The supply air may include a flow of outdoor air drawn from an ambient environment surrounding the HVAC system, a flow of return air drawn from an interior of the building, or a mixture of both the outdoor air and the return air. In any case, the fan may direct the supply air across a heat exchange area of the evaporator to enable cooled refrigerant circulating through the evaporator to absorb thermal energy from the supply air. As such, the evaporator may reduce a temperature of the supply air and discharge the supply air as a flow of conditioned air (e.g., cooled air), which has a temperature that is less than a temperature of the supply air.

In certain cases, by cooling the supply air, the evaporator may also cause moisture suspended or contained within the supply air to condense. Specifically, moisture condensed from the flow of supply air may accumulate on a surface of the evaporator as condensate. The condensate may flow along the evaporator and drip into a drain pan that may be positioned beneath the evaporator (e.g., with respect to a direction of gravity). As such, a humidity level of the flow of conditioned air discharging from the evaporator may be less than a humidity level of the supply air received at the evaporator. The fan may direct the cooled, dehumidified air discharging from the evaporator along the flow path and into the building. In this manner, the HVAC system may be used to regulate a temperature and/or humidity level within an interior of the building.

In some cases, it may be desirable to reduce the humidity level within the building substantially without adjusting a current temperature within the building (e.g., without heating or cooling the interior of the building). For example, in certain cases, a temperature within the building (e.g., a temperature within one or more rooms, zones, or other spaces of the building) may be within a threshold range of a designated target temperature setpoint, while a humidity level within the building may exceed a designated target humidity level setpoint beyond an acceptable tolerance. In such situations, it may be desirable to operate the HVAC system in a dehumidification mode, in which the HVAC system may operate to dehumidify the building substantially without heating or cooling of the building.

To facilitate operation in the dehumidification mode, the HVAC system may include a reheat coil that is fluidly coupled to the vapor compression system and configured to reheat (e.g., increase a temperature of) the cooled, dehumidified air discharging from the evaporator before the air is directed into the building. For example, the reheat coil may be positioned within the air flow path and downstream of the evaporator, such that the reheat coil may receive the cooled, dehumidified air discharging from the evaporator. The compressor may be configured to receive, from the evaporator, a flow of heated refrigerant that has previously absorbed thermal energy from the supply air. The compressor may compress the refrigerant received from the evaporator, which adds more heat to the refrigerant, and direct the heated refrigerant toward and through a reheat valve (e.g., a three-way valve) that is positionable to direct at least a portion of the heated refrigerant to the reheat coil, while directing a remaining portion of the heated refrigerant toward the condenser. As such, the cooled, dehumidified air discharging from the evaporator and directed across the reheat coil may re-absorb thermal energy from the heated refrigerant circulating through the reheat coil. Accordingly, the reheat coil may increase a temperature of the cooled, dehumidified air discharging from the evaporator prior to delivery of the dehumidified air to the building. The refrigerant that has passed through the reheat coil may returned to the refrigerant loop up stream of the compressor and downstream of the condenser.

In typical HVAC systems, a condenser fan (or a plurality of condenser fans) of the condenser may be operational (e.g., on, active) while the HVAC system operates in the dehumidification mode. As such, the condenser fan may draw ambient air across the condenser to facilitate condensation of refrigerant within the condenser. In some cases, operation of the condenser fan may result in charge migration in the vapor compression system that reduces an operational efficiency of the reheat coil. For example, when the HVAC system operates in the dehumidification mode, operation of the condenser fan may cause relatively cool, low pressure refrigerant to condense and accumulate within the condenser and/or within refrigerant conduits adjacent to the condenser, thereby reducing a quantity of available refrigerant that the compressor may recirculate through a remainder of the vapor compression system, such as a reheat section of the vapor compression system that includes the reheat coil and the evaporator. As a result, the quantity of refrigerant remaining in the reheat section of the vapor compression system may be insufficient to enable adequate operation of the reheat coil.

For example, particularly in high-load periods of the reheat coil, the reduced quantity of refrigerant available in the reheat section of the vapor compression system may be such that, even when the reheat valve is adjusted to direct a majority of or substantially all of the heated refrigerant discharging from the compressor to the reheat coil, an amount of refrigerant arriving at the reheat coil is inadequate to enable the reheat coil to sufficiently reheat the cooled, dehumidified air to output a flow of neutral air. For clarity, as used herein, "neutral air" may refer to air that is output by the reheat coil and supplied to the building by the HVAC system at a temperature that is substantially matching (e.g., within a threshold temperature range of) a current temperature within the building or a set point temperature for the building, and has a humidity level that is less than a humidity level of return air extracted from the building.

Accordingly, embodiments of the present disclosure relate to a reheat control system that is configured to eliminate or substantially mitigate undesired charge migration within the vapor compression system that would otherwise reduce an operational efficiency of the reheat coil. Specifically, as discussed in detail herein, the reheat control system may adjust operation of the condenser fan based on a position of the reheat valve to ensure that sufficient refrigerant is available in the reheat section of the vapor compression system to satisfy a refrigerant demand of the reheat coil. In this manner, the reheat control system may facilitate supply and delivery of neutral air having a temperature that substantially matches (e.g., is within 2 degrees Fahrenheit of) an air temperature (set point or actual) within an interior of the building or other structure serviced by the HVAC system and has a humidity level that is less than a humidity level of a return air flow extracted from the building or structure. In this way, the HVAC system is operable to facilitate dehumidification within the building substantially without heating or cooling of an interior of the building beyond a desired or established temperature.

For example, the reheat control system may include a controller that is configured to facilitate performance of some of or all of the techniques disclosed herein. The controller may be configured to monitor a temperature of outdoor air surrounding the HVAC system via feedback acquired by the one or more temperature sensors. The controller may adjust operation of the condenser fan based on the acquired sensor feedback. For example, as discussed herein, the controller may be configured to retain the condenser fan in a non-operational (e.g., inactive) state upon determining that the temperate of the outdoor air is below a threshold value, and may be configured to activate and operate the condenser fan upon determining that the temperature of the outdoor air reaches or exceeds the threshold value.

The controller may monitor a position of the reheat valve throughout operation of the HVAC system in the dehumidification mode. The reheat valve may be configured to transition between a fully open position, a fully closed position, and a plurality of intermediate positions that are between the fully open and fully closed positions. In the fully open position, the reheat valve may divert all of or substantially all of (e.g., 80 percent or more) of the heated refrigerant discharging from the compressor to the reheat coil, while diverting none of or a minimal portion of (e.g., 20 percent or less) of the heated refrigerant discharging from the compressor to the condenser. In the fully closed position, the reheat valve may block flow of the heated refrigerant from the compressor to the reheat coil, such that all of the heated refrigerant output by compressor is directed toward the condenser.

Accordingly, a degree of opening of the reheat valve may affect diversion of refrigerant between the reheat coil and the condenser. As user herein, the "degree of opening" of the reheat valve may refer to a current position of the reheat valve (e.g., at a particular instance in time) with respect to the fully closed position of the reheat valve. Accordingly, while the reheat valve has a relatively low degree of opening (e.g., less than 50 percent of a total permitted valve opening), the reheat valve may bias refrigerant distribution from the compressor to the condenser. Conversely, while the reheat valve has a relatively high degree of opening (e.g., equal to or greater than 50 percent of the total permitted valve opening), the reheat valve may bias refrigerant distribution from the compressor to the reheat coil. As discussed in detail herein, the controller may adjust the degree of opening of the reheat valve (e.g., modulate a position of the reheat valve) based on one or more monitored operational parameters of the HVAC system to provide a desired quantity (e.g., flow rate) of heated refrigerant to the reheat coil.

Upon receiving feedback indicating that a degree of opening of the reheat valve remains less than a threshold degree of opening (e.g., a threshold opening setpoint, a position less than 80 percent of the total permitted valve opening) during operation of the HVAC system in dehumidification mode, the controller may adjust operation of the condenser fan based on the temperature of the outdoor air surrounding the HVAC system, as set forth above. In response to determining that the degree of opening of the reheat valve reaches or exceeds the threshold degree of opening, the controller may deactivate the condenser fan, regardless of the current outdoor temperature. As a result, by substantially reducing air flow across the condenser, the controller may reduce or substantially inhibit condensation of refrigerant within the condenser and, instead, enable the refrigerant to absorb thermal energy from the surrounding environment. Heating of the refrigerant within the condenser may cause a pressure within the condenser to increase and, thus, force refrigerant from the condenser and adjacent conduits into the reheat section of the vapor compression system. As such, the controller may substantially eliminate refrigerant accumulation within and near the condenser to ensure that, particularly while the reheat valve is substantially open (e.g., opened beyond the threshold degree of opening), such as when a refrigerant demand of the reheat coil is relatively high, sufficient refrigerant is available in the reheat portion of the vapor compression system to satisfy the refrigerant demand of the reheat coil. The controller may continue to keep the condenser fan in the non-operational state at least until the degree of opening of the reheat valve returns back below the threshold degree of opening. These and other features will be described below with reference to the drawings.

Turning now to the drawings, FIG. 1 illustrates an embodiment of a heating, ventilation, and/or air conditioning (HVAC) system for environmental management that employs one or more HVAC units in accordance with the present disclosure. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12 with a reheat system in accordance with present embodiments. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
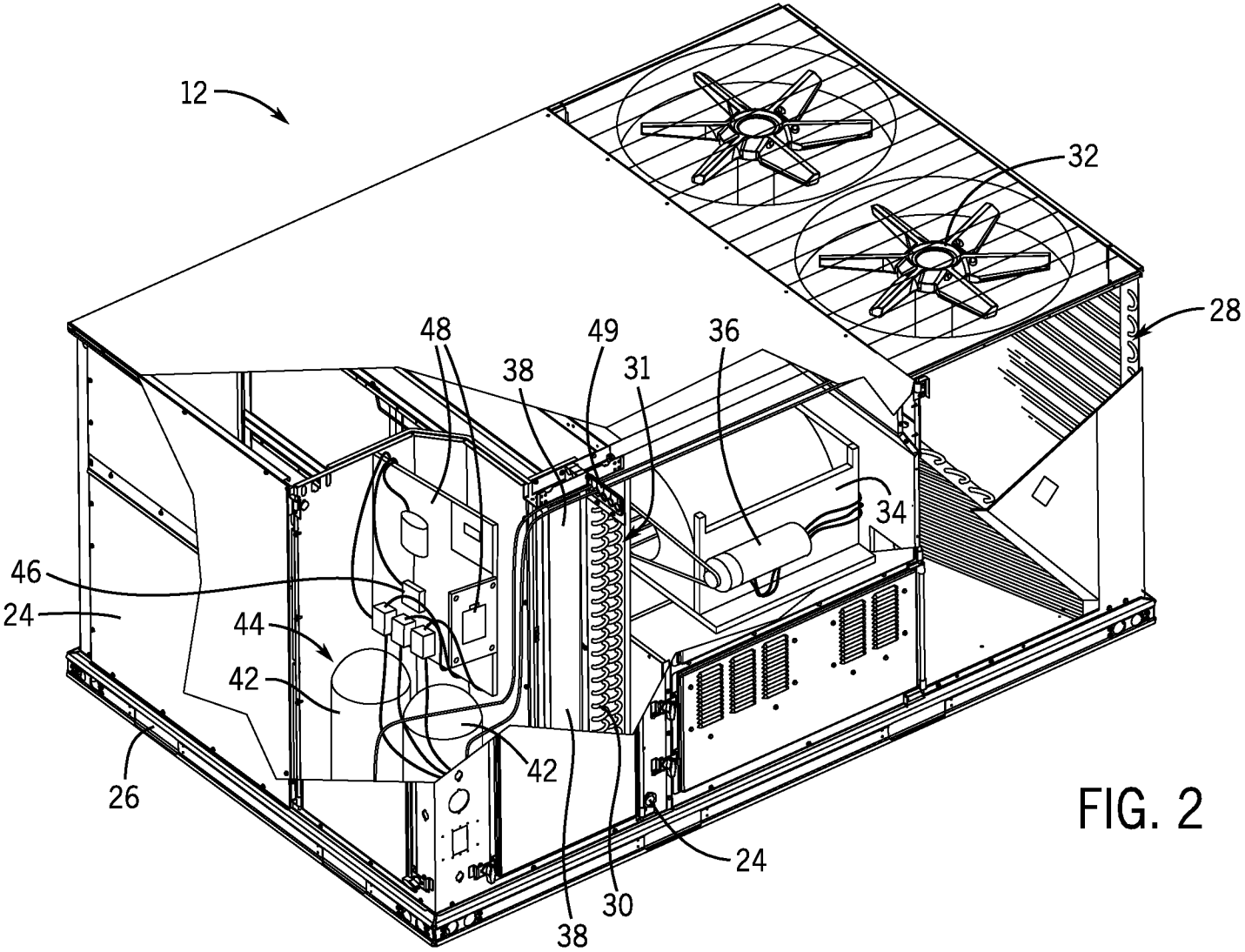
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
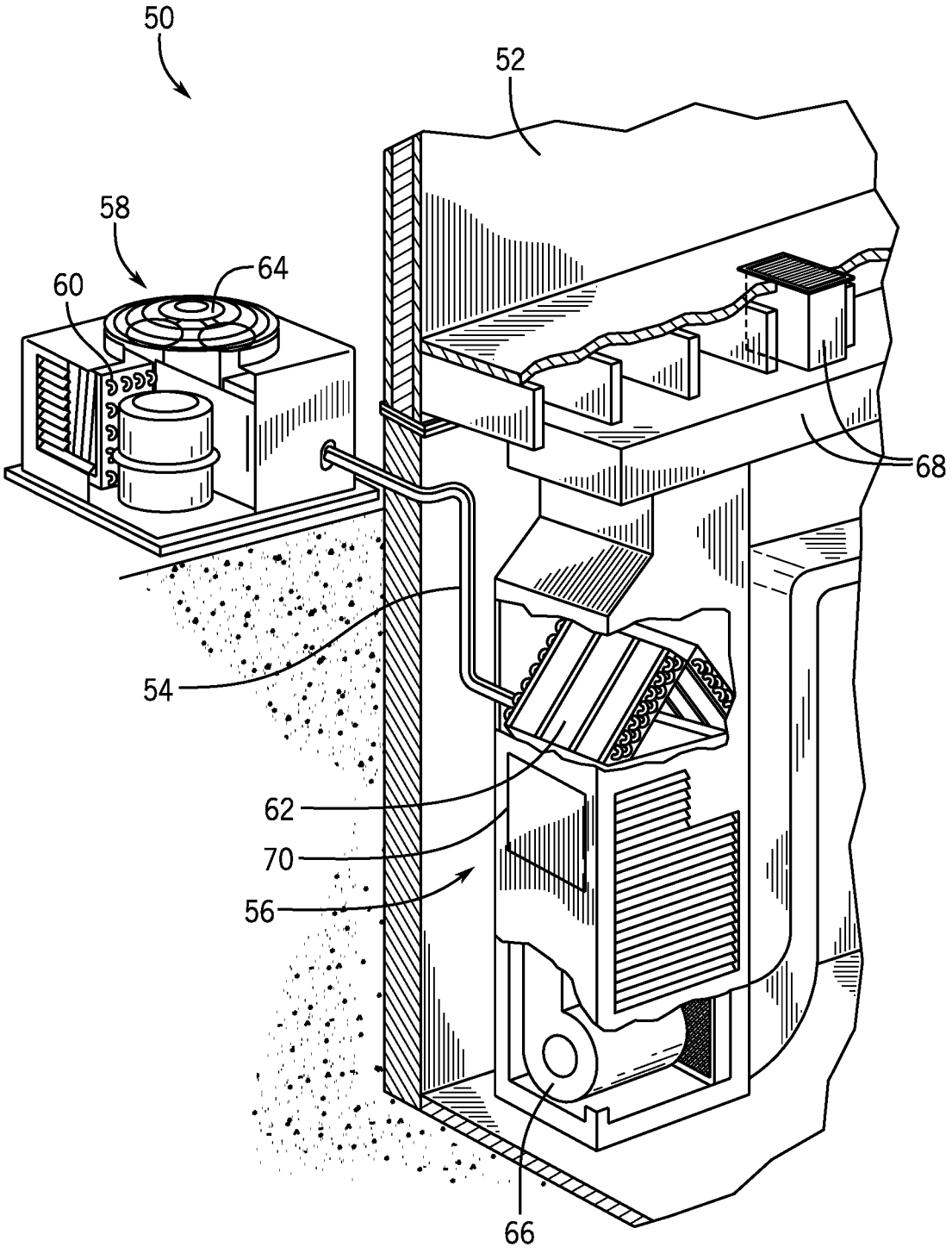
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily. The outdoor unit 58 includes a reheat system in accordance with present embodiments.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
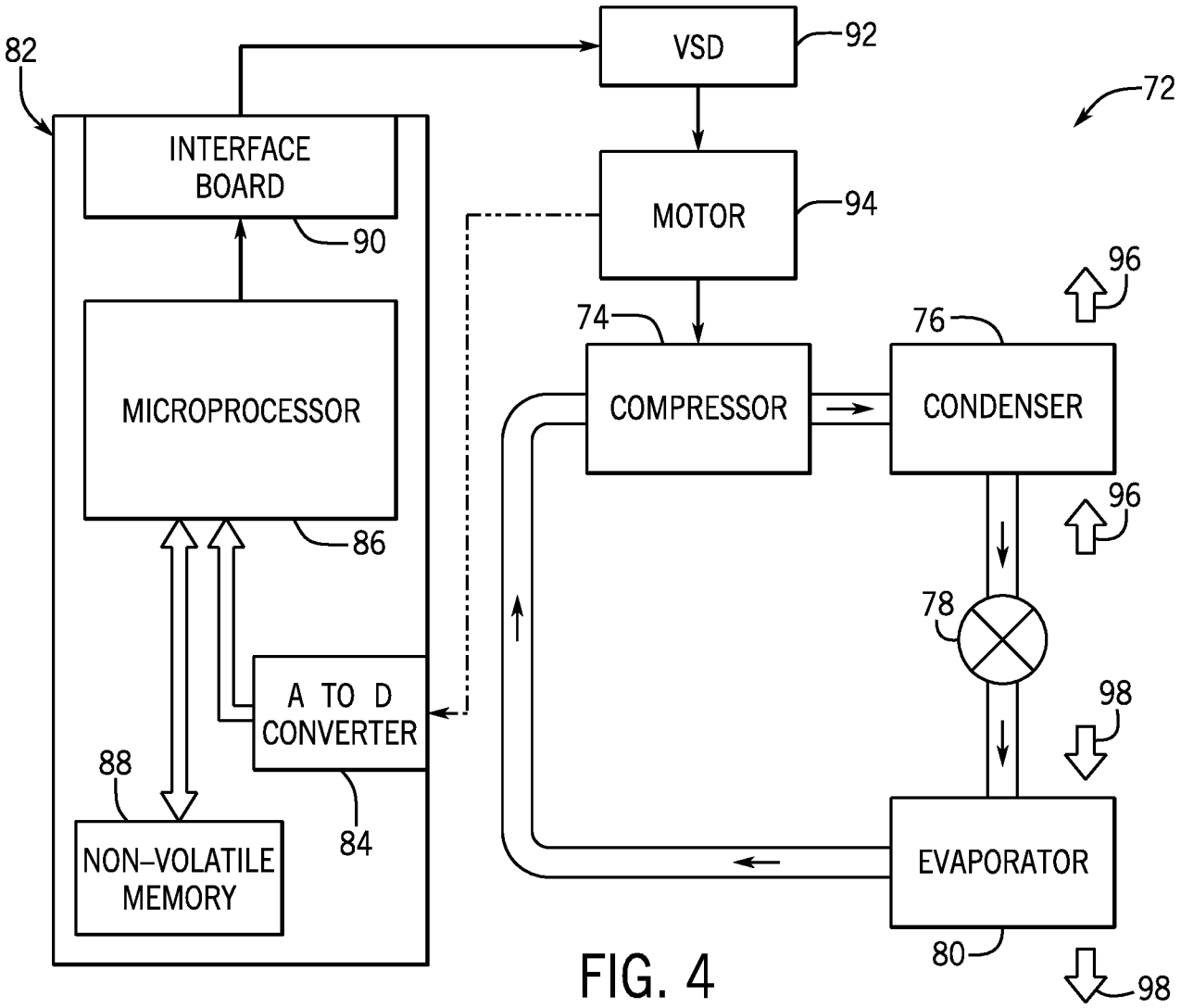
FIG. 4 is a schematic diagram of an embodiment of a vapor compression system used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil. In the illustrated embodiment, the reheat coil is represented as part of the evaporator 80. The reheat coil is positioned downstream of the evaporator heat exchanger relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
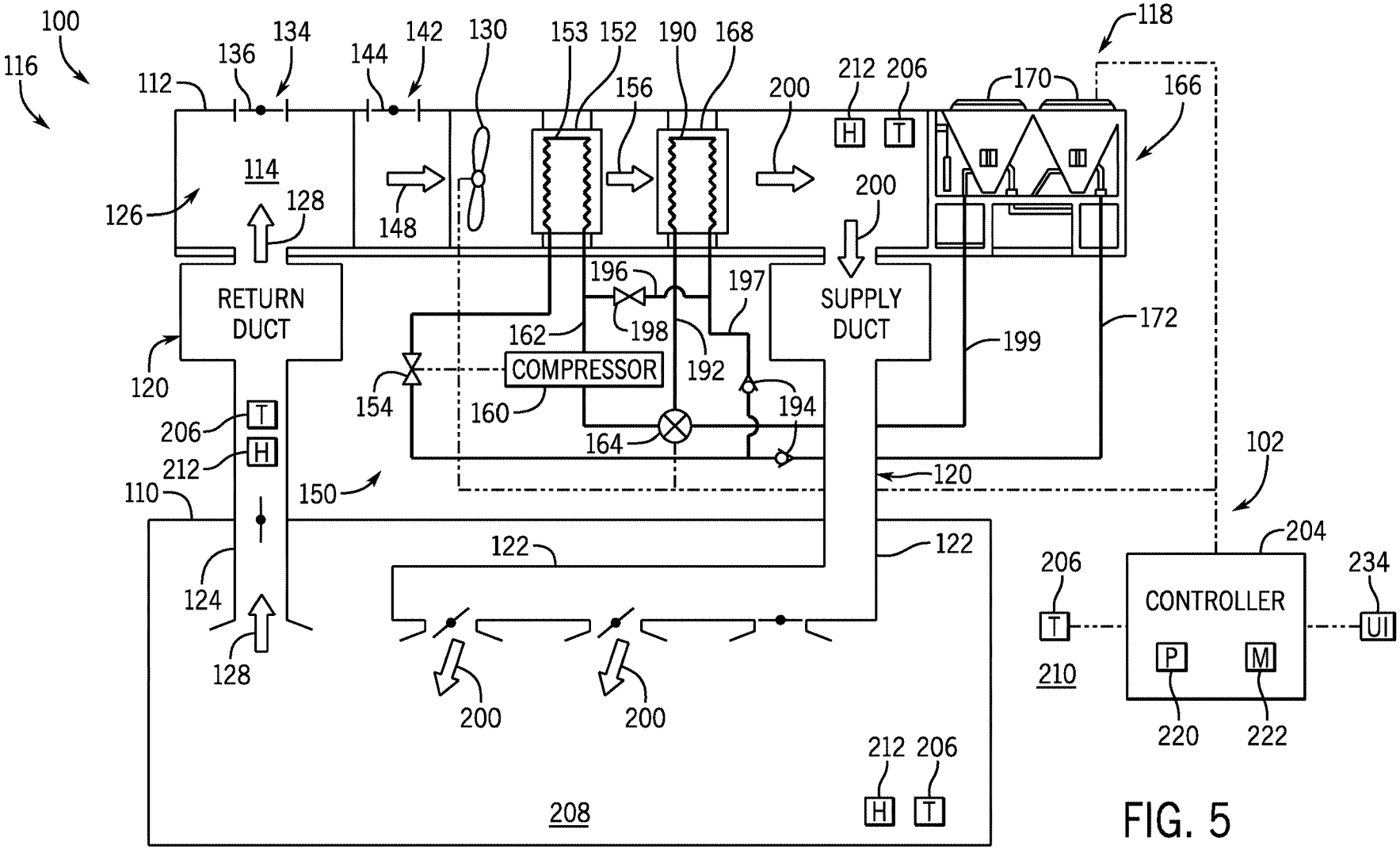
FIG. 5 is a schematic diagram of an embodiment of an HVAC system having a reheat coil, in accordance with an aspect of the present disclosure.

As briefly discussed above, embodiments of the present disclosure are directed to a reheat control system that facilitates supply of dehumidified air to a room or zone within a building via an HVAC system. Additionally, the reheat control system facilitates mitigating or substantially eliminating charge migration in a vapor compression system of the HVAC system during dehumidification operations performed by the HVAC system. To provide context for the following discussion, FIG. 5 is a schematic of an embodiment of an HVAC system 100 having a reheat control system 102. The HVAC system 100 may be configured to direct a flow of conditioned air (e.g., heated air, cooled air, dehumidified air) to a thermal load 110, such as a space within a building, residential home, or other suitable structure. It should be appreciated that the HVAC system 100 may include embodiments or components of the HVAC unit 12 shown in FIGS. 1 and 2, embodiments or components of the split residential heating and cooling system 50 shown in FIG. 3, a rooftop unit (RTU), or any other suitable air handling unit or HVAC system.

In the illustrated embodiment, the HVAC system 100 includes an enclosure 112 that forms an air flow path 114 through the HVAC system 100. The air flow path 114 extends from an upstream end portion 116 of the HVAC system 100 to a downstream end portion 118 of the HVAC system 100. The enclosure 112 may be in fluid communication with the thermal load 110 via an air distribution system, such as a system of ductwork 120, which includes a supply duct 122 and a return duct 124. The return duct 124 may be coupled to a plenum 126 of the enclosure 112 that is configured to receive a flow of return air 128 from the thermal load 110. Particularly, a fan or blower 130 of the HVAC system 100 may be operable to draw the return air 128 into the enclosure 112 via the return duct 124. The enclosure 112 may include an exhaust air outlet 134 that enables the HVAC system 100 to exhaust a portion of the return air 128 into an ambient environment, such as the atmosphere. The exhaust air outlet 134 generally includes an exhaust air damper 136 that is configured to regulate a flow rate of the exhaust air discharging through the exhaust air outlet 134. In some embodiments, the enclosure 112 includes an outdoor air inlet 142 that enables the HVAC system 100 to intake (e.g., via the blower 130) fresh outdoor air from the ambient environment. The outdoor air inlet 142 may include an outdoor air damper 144 that is configured to regulate a flow rate of the outdoor air entering the plenum 126. In some embodiments, at least a portion of the return air 128 may mix with outdoor air entering the plenum 126 to form a flow of supply air 148, which may include both the outdoor air and the return air 128. In other embodiments, the supply air 148 may include only the return air 128 received via the return duct 124 or only the outdoor air dawn into the plenum 126 via the outdoor air inlet 142.

In the illustrated embodiment, the HVAC system includes a vapor compression system 150, such as the vapor compression system 72, which includes an evaporator 152. The evaporator 152 is positioned within the air flow path 114 and is configured to receive a flow of cooled refrigerant from an expansion device 154 of the vapor compression system 150. The blower 130 may force the supply air 148 across the evaporator 152 to enable cooled refrigerant circulating through one or more evaporator coils 153 of the evaporator 152 to absorb thermal energy from the supply air 148. The evaporator coils 153 may, in some embodiments, absorb an amount of thermal energy from the supply air 148 that is sufficient to cause moisture suspended within the supply air 148 to condense on the evaporator coils 153. Accordingly, the supply air 148 may discharge from the evaporator 152 as cooled, dehumidified air 156 having a temperature value and a humidity level that are less than a temperature value and a humidity level of the supply air 148 received at the evaporator 152. Condensate accumulating on the evaporator coils 153 may gradually drip into a drain pan positioned beneath the evaporator 152, with respect to a direction of gravity, such that the condensate may be collected within the drain pan and subsequently drained from the enclosure 112 (e.g., via a drain port formed in the drain pan).

The evaporator 152 may discharge, via a conduit 162, a flow of heated refrigerant that has absorbed thermal energy from the supply air 148. The heated refrigerant may flow through the conduit 162 and toward a compressor 160 of the vapor compression system 150. The compressor 160 may compress the refrigerant, which adds heat, and direct the heated refrigerant through a reheat valve 164 that, as discussed in detail below, is configured to regulate diversion (e.g., division) of the heated refrigerant between a condenser 166 and a reheat coil 168 of the vapor compression system 150.

The condenser 166 may include one or more condenser coils that are configured to facilitate heat exchange between heated refrigerant received from the reheat valve 164 and the ambient environment. For example, the condenser 166 may include one or more condenser fans 170 that are operable to draw a flow of ambient air across the condenser coils of the condenser 166. Accordingly, the ambient air may absorb thermal energy from the refrigerant circulating through the condenser coils, thereby cooling the refrigerant before the refrigerant is discharged from the condenser 166 via a conduit 172. The compressor 160 may direct the cooled refrigerant discharging from the condenser 166 back to the evaporator 152 for reuse via the conduit 172. As such, the evaporator 152, the expansion device 154, the compressor 160, the condenser 166, and the corresponding refrigerant conduits extending therebetween may collectively form a refrigerant loop or circuit of the vapor compression system 150.

In the illustrated embodiment, the reheat coil 168 is disposed within the air flow path 114 and is positioned downstream, with respect to a direction of air flow through the enclosure 112, of the evaporator 152. One or more coils 190 of the reheat coil 168 are fluidly coupled to the reheat valve 164 via a conduit 192. Accordingly, the coils 190 may receive heated refrigerant from the reheat valve 164 and place the heated refrigerant in thermal communication with cooled, dehumidified air 156 flowing along the air flow path 114.

In certain embodiments, respective check valves 194 may be positioned along conduits of the vapor compression system 150 and configured to block refrigerant flow through the conduits in undesired directions (e.g., in an upstream direction, with respect to a flow of the refrigerant through the compressor 160). In some embodiments, a bleed down conduit 196 may extend between the conduit 162 and a conduit 197 extending from the reheat coil 168. The bleed down conduit 196 may include a bleed down valve 198 configured to regulate refrigerant flow between the conduit 192 and the conduit 197 during bleed down operations of the vapor compression system 150.

In some embodiments, the reheat valve 164 may be a three-way modulating valve that, as noted above, is operable to regulate diversion of refrigerant from the compressor 160 to the reheat coil 168 and/or from the compressor 160 to the condenser 166. In particular, the reheat valve 164 may control flow parameters, such as a flow rate and/or a flow pressure, of the refrigerant flowing from the compressor 160 into the coils 190 of the reheat coil 168 and/or of the refrigerant flowing from the compressor 160 into the condenser coils of the condenser 166. As such, the reheat valve 164 enables operation of the HVAC system 100 in a reheat or dehumidification mode, in which at least a portion of the heated refrigerant discharging from the compressor 160 is directed through the reheat coil 168 to reheat the cooled, dehumidified air 156, and in a cooling mode, in which substantially no heated refrigerant discharging from the compressor 160 is directed through the reheat coil 168.

For example, the reheat valve 164 may be configured to transition between a fully open position, a fully closed position, and a plurality of intermediate or partially open positions that are between the fully open and fully closed positions. In the fully open position, the reheat valve 164 may divert all of or substantially all of (e.g., 80 percent or more) of the heated refrigerant discharging from the compressor 160 into the conduit 192 and to the reheat coil 168, while diverting none of or a minimal portion of (e.g., 20 percent or less) of the heated refrigerant discharging from the compressor 160 into a conduit 199 and to the condenser 166. In the fully closed position, the reheat valve 164 may block flow of the heated refrigerant from the compressor 160 to the reheat coil 168, such that all of the heated refrigerant output by compressor 160 is directed toward the condenser 166. Accordingly, when the reheat valve 164 has a relatively low degree of opening (e.g., less than 50 percent of a total permitted valve opening), the reheat valve 164 may bias refrigerant distribution from the compressor 160 to the condenser 166. Conversely, while the reheat valve 164 has a relatively high degree of opening (e.g., equal to or greater than 50 percent of the total permitted valve opening), the reheat valve 164 may bias refrigerant distribution from the compressor 160 to the reheat coil 168.

For clarity, as used herein, a "modulating valve" may refer to any suitable valve or flow control device, such as a step-less valve, which is operable to incrementally adjust a flow rate and/or a flow pressure of a fluid flow across the modulating valve. For example, in some embodiments, the reheat valve 164 may be adjustable to 1, 5, 10, 20, 30, 50, or more than 50 discrete positions that enable precise adjustment of fluid flow parameters across the reheat valve 164. Although the reheat valve 164 is illustrated as a three-way valve in the illustrated embodiment of FIG. 5, it should be appreciated that, in other embodiments, the reheat valve 164 may include a plurality of two-way valves (e.g., on/off valves) configured to regulate diversion of refrigerant from the compressor 160 to the reheat coil 168 and/or to the condenser 166 in accordance with the techniques discussed herein.

The blower 130 may force the cooled, dehumidified air 156 discharging from the evaporator 152 across the coils 190 of the reheat coil 168. Accordingly, while the HVAC system 100 operates in the dehumidification mode, the cooled, dehumidified air 156 may absorb thermal energy from the heated refrigerant circulating through the coils 190. Accordingly, the reheat coil 168 may discharge reheated, dehumidified air 200 at a temperature value that is greater than a temperature value of the cooled, dehumidified air 156 received at the reheat coil 168.

In the illustrated embodiment, the reheat control system 102 includes a controller 204 this is configured to adjust the degree of opening of the reheat valve 164 (e.g., configured to modulate a position of the reheat valve 164) based on one or more operational parameters of the HVAC system 100 to provide a desired quantity (e.g., flow rate) of heated refrigerant to the reheat coil 168. As such, the controller may operate the reheat valve 164 to adjust an amount of reheat provided by the reheat coil 168. For example, the controller 204 may be communicatively coupled to one or more temperature sensors 206 configured to provide the controller 204 with feedback indicative of a temperature within an interior 208 of the thermal load 110, a temperature of the return air 128, a temperature of the reheated, dehumidified air 200, a temperature of ambient outdoor air 210 surrounding the HVAC system 100, and/or other suitable temperature feedback. Additionally, the controller 204 may be communicatively coupled to one or more humidity sensors 212 configured to provide the controller 204 with feedback indicative of a humidity level within the interior 208 of the thermal load 110, a humidity level of the return air 128, a humidity level of the reheated, dehumidified air 200, and/or other suitable humidity feedback.

As discussed in detail below, the controller 204 may adjust the degree of opening of the reheat valve 164 based on feedback from the sensors 206 and/or 212 such that the reheat coil 168 provides thermal energy transfer to the cooled, dehumidified air 156 that is sufficient to discharge the reheated, dehumidified air 200 at a temperature that is substantially equal to a temperature of the return air 128 drawn from the thermal load 110, for example. In this manner, the controller 204 may facilitate operating the HVAC system 100 to supply neutral air to the thermal load 110. As used herein, a flow of "neutral air" may refer to a flow of reheated, dehumidified air 200 having a temperature value that is substantially equal to, such as within ten percent of, or within two degrees of, a temperature value of the return air 128, and that includes a humidity level that is less than a humidity level of the return air 128. That is, "neutral air" may refer to a flow of the reheated, dehumidified air 200 that, at a particular instance in time, has a temperature that is substantially equal to an actual temperature within the interior 174 of the thermal load 110 and/or to a target set point temperature for the interior 174 at that same instance in time, and has a humidity level that is less than the humidity level within the thermal load 110. Accordingly, it should be understood that, when supplying the thermal load 110 with the reheated, dehumidified air 200 having properties of the "neutral air," the HVAC system 100 may circulate air throughout the thermal load 110 to dehumidify the thermal load 110 substantially without heating or cooling the interior 174 of the thermal load 110.

In some embodiments, the controller 204 may include a portion or all of the control panel 82 (see FIG. 4) or may be another suitable controller included in the HVAC system 100. In any case, the controller 204 may be used to control components of the HVAC system 100 in accordance with the techniques discussed herein to enable operation of the HVAC system 100 in the dehumidification mode. For example, one or more control transfer devices, such as wires, cables, wireless communication devices, and the like, may communicatively couple the blower 130, the expansion device 154, the compressor 160, the one or more condenser fans 170, the reheat valve 164, the sensors 206 and 212, and/or any other suitable components of the HVAC system 100 to the controller 204. That is, the blower 130, the expansion device 154, the compressor 160, the condenser fans 170, the reheat valve 164, and/or the sensors 206 and 212 may each have a communication component that facilitates wired or wireless communication between the controller 204, the blower 130, the expansion device 154, the compressor 160, the condenser fans 170, the reheat valve 164, and/or the sensors 206 and 212 via a network. In some embodiments, the communication component may include a network interface that enables the components of the HVAC system 100 to communicate via various protocols such as EtherNet/IP, ControlNet, DeviceNet, or any other communication network protocol. Alternatively, the communication component may enable the components of the HVAC system 100 to communicate via mobile telecommunications technology, Bluetooth®, near-field communications technology, and the like. As such, the controller 204, the blower 130, the expansion device 154, the compressor 160, the condenser fans 170, the reheat valve 164, and/or the sensors 206 and 212 may wirelessly communicate data between each other.

The controller 204 includes a processor 220, such as a microprocessor, which may execute software for controlling the components of the HVAC system 100 and/or the components of the reheat control system 102. The processor 220 may include multiple microprocessors, one or more "general-purpose" microprocessors, one or more special-purpose microprocessors, and/or one or more application specific integrated circuits (ASICS), or some combination thereof. For example, the processor 220 may include one or more reduced instruction set (RISC) processors. The controller 204 may also include a memory device 222 that may store information such as instructions, control software, look up tables, configuration data, etc. The memory device 222 may include a volatile memory, such as random access memory (RAM), and/or a nonvolatile memory, such as read-only memory (ROM). The memory device 222 may store a variety of information and may be used for various purposes. For example, the memory device 222 may store processor-executable instructions including firmware or software for the processor 220 execute, such as instructions for controlling components of the HVAC system 100. In some embodiments, the memory device 222 is a tangible, non-transitory, machine-readable-medium that may store machine-readable instructions for the processor 220 to execute. The memory device 222 may include ROM, flash memory, a hard drive, or any other suitable optical, magnetic, or solid-state storage medium, or a combination thereof. The memory device 222 may store data, instructions, and any other suitable data.

Figure 6:
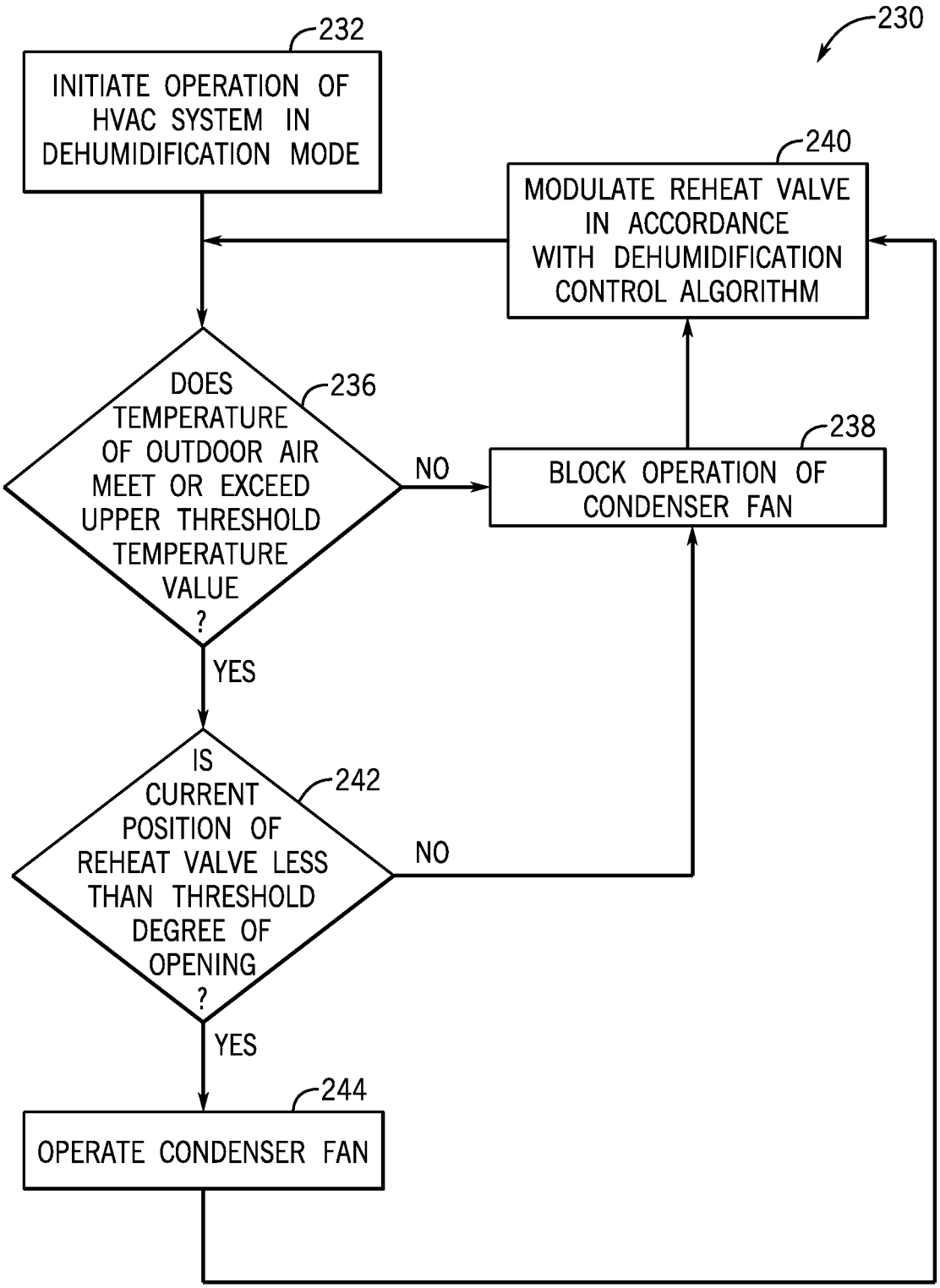
FIG. 6 is a flow diagram of an embodiment of a process of operating an HVAC system having a reheat coil, in accordance with an aspect of the present disclosure.

FIG. 6 is flow diagram of an embodiment of a process 230 that may be used to control the HVAC system 100 to facilitate supply of dehumidified air, such as neutral air, to the thermal load 110. Moreover, as discussed in detail below, execution of the process 230 may reduce or substantially eliminating charge migration in the vapor compression system 150 that may otherwise impede generation and supply of the neutral air via the HVAC system 100. FIG. 6 will be referred to concurrently with FIG. 5 throughout the following discussion. It should be noted that the steps of the process 230 discussed below may be performed in any suitable order and are not limited to the order shown in the illustrated embodiment of FIG. 6. Moreover, it should be noted that additional steps of the process 230 may be performed, and certain steps of the process 230 may be omitted. In some embodiments, the process 230 may be executed on the processor 220, the microprocessor 86, and/or any other suitable processor of the HVAC system 100. The process 230 may be stored on, for example, the memory 88 or the memory device 222.

The process 230 may begin with the controller 204 receiving an indication to initiate operation of the HVAC system 100 in the dehumidification mode, as indicated by block 232. For example, in some embodiments, the controller 204 may receive user input instructing the controller 204 to initiate operation of the HVAC system 100 in the dehumidification mode via a user interface 234 (see FIG. 5) coupled to the controller 204. Additionally or alternatively, the controller 204 may initiate operation of the HVAC system 100 in the dehumidification mode upon receiving feedback from the one or more humidity sensors 212 indicating that a humidity level within the interior 208 of the thermal load 110 reaches or exceeds a threshold humidity level.

In any case, upon receiving the indication to operate the HVAC system 100 in the dehumidification mode, the controller 204 may determine whether a temperature of the outdoor air 210 surrounding the HVAC system 100 meets or exceeds an upper threshold temperature value, as indicated by block 236. For example, the controller 204 may receive feedback from the one or more temperature sensors 206, from a remote weather station, or from another suitable source indicating the temperature of the outdoor air 210. The controller 204 may compare the temperature of the outdoor air 210 to the upper threshold temperature value to determine whether the temperature of the outdoor air 210 meets or exceeds the upper threshold temperature value. As a non-limiting example, the upper threshold temperature value may be between 70 degrees Fahrenheit and 95 degrees Fahrenheit. In some embodiments, the upper threshold temperature value may be a predetermined value stored in, for example, the memory device 222 of the controller 204. In other embodiments, the upper threshold temperature value may be variable and adjusted based on feedback received at the controller 204. For example, the upper threshold temperature value may be adjusted based on feedback (e.g., user input) received via the user interface 234. Additionally or alternatively, the upper threshold temperature value may be adjusted based on feedback received from the one or more sensors 206 and/or 212 or other suitable sensors of the HVAC system 100.

In any case, in response to determining, at block 236, that the temperature of the outdoor air 210 is less than the upper threshold temperature value, the controller 204 may block operation of the condenser fan 170 or fans, as indicated by block 238. Particularly, if the condenser fan 170 is operational (e.g., activated) prior to execution of block 236, the controller 204 may deactivate the condenser fan 170 at block 238. Conversely, if the condenser fan 170 is already non-operational (e.g., in-active) prior to execution of the block 236, the controller 204 may continue to maintain the condenser fan 170 in the non-operational state.

In some embodiments, upon execution of the block 238, the controller 204 may modulate the reheat valve 164 in accordance with a dehumidification control algorithm, as indicated by block 240, to provide dehumidified air to the thermal load 110 in accordance with the techniques discussed above. Particularly, the controller 204 may operate the reheat valve 164 to provide neutral air to the thermal load 110. For example, the controller 204 may receive feedback indicative of a reference temperature for the neutral air. The reference temperature may be indicative of a temperature within the interior 208 or a temperature of the return air 128, as measured by the one or more temperature sensors 206. In certain embodiments, the reference temperature may include a target temperature set point for the interior 208 that is input via the user interface 234. In any case, the controller 204 may compare a temperature of the reheated, dehumidified air 200 (e.g., as measured by the one or more temperature sensors 206) to the reference temperature to determine whether the temperature of the reheated, dehumidified air 200 is within a threshold range of the reference temperature.

As a non-limiting example, in response to determining that that temperature of the reheated, dehumidified air 200 is below the reference temperature (e.g., by a threshold amount, such as 2 degrees Fahrenheit), the controller 204 may increase a degree of opening of the reheat valve 164 (e.g., by a threshold increment) to increase a mass flow rate of heated refrigerant from the compressor 160 to the reheat coil 168 and decrease a mass flow rate of heated refrigerant from the compressor 160 to the condenser 166. As such, the controller 204 may increase a heat transfer rate between the heated refrigerant circulating through the reheat coil 168 and the air flowing across the reheat coil 168, such that the controller 204 may effectuate an increase in the temperature of the reheated, dehumidified air 200 discharging from the reheat coil 168. Conversely, in response to determining that that the temperature of the reheated, dehumidified air 200 exceeds the reference temperature (e.g., by a threshold amount, such as 2 degree Fahrenheit), the controller 204 may decrease a degree of opening of the reheat valve 164 (e.g., by a threshold increment) to decrease a mass flow rate of heated refrigerant from the compressor 160 to the reheat coil 168 and increase a mass flow rate of heated refrigerant from the compressor 160 to the condenser 166. As such, the controller 204 may decrease a heat transfer rate between the heated refrigerant circulating through the reheat coil 168 and the air flowing across the reheat coil 168, such that the controller 204 may effectuate a decrease in the temperature of the reheated, dehumidified air 200. The controller 204 may iteratively execute blocks 236, 238, and 240 such that an actual temperature of the reheated, dehumidified air 200 output by the HVAC system 100 may approach and/or reach the reference temperature. As such, the HVAC system 100 may provide the reheated, dehumidified air 200 to the thermal load as neutral air.

In response to determining (e.g., based on feedback from the one or more temperature sensors 206), at block 236, that the temperature of the outdoor air 210 meets or exceeds the upper threshold temperature value, the controller 204 may determine whether a position (e.g., a current degree of opening) of the reheat valve 164 is less than a threshold degree of opening, as indicated by the block 242. The controller 204 may determine the position of the reheat valve 164 based on feedback from a sensor (e.g., a position sensor) that is integrated with or separate from the reheat valve 164, based on feedback from an actuator used to operate the reheat valve 164, or based on feedback from another suitable source. In response to determining that the position of the reheat valve 164 is less than the threshold degree of opening, the controller 204 may activate or continue to operate the condenser fan 170 to draw air across the condenser 166, as indicated by block 244. That is, if the condenser fan 170 is non-operational (e.g., de-activated) prior to execution of block 242, the controller 204 may activate the condenser fan 170 at block 244. If the condenser fan 170 is already operational (e.g., active) prior to execution of block 242, the controller 204 may continue to maintain the condenser fan 170 in the operational state. As shown in the illustrated embodiment of FIG. 6, upon execution of block 244, the controller 204 may execute block 240 to control operation of the reheat valve 164 in accordance with the techniques discussed above and may subsequently initiate another iteration of the process 230.

In response to determining, at the block 242, that the position of the reheat valve 164 reaches or exceeds the threshold degree of opening, the controller 204 may deactivate or continue to block operation of the condenser fan 170, as indicated by block 238. By blocking operation of the condenser fan 170 when the reheat valve 164 opens beyond the threshold degree of opening, such as when a heated refrigerant demand of the reheat coil 168 is elevated, the controller 204 may ensure that a sufficient quantity of refrigerant is available in the reheat section of the vapor compression system 150 to satisfy the demand of the reheat coil 168. That is, in accordance with the techniques discussed above, the controller 204 may ensure that refrigerant does not accumulate within the condenser 166 and result in a deficiency of available refrigerant in the reheat section of the vapor compression system 150. For clarity, the reheat section of the vapor compression system 150 may include, for example, the expansion device 154, the evaporator 152, the compressor 160, the reheat valve 164, the reheat coil 168, and the conduits extending therebetween. As a non-limiting example, the threshold degree of opening of the reheat valve 164 may correspond to a position of the reheat valve 164 that is between 60 percent and 100 percent of a total permitted valve opening of the reheat valve 164. Moreover, in some embodiments, when the reheat valve 164 is positioned at the threshold degree of opening, the reheat valve 164 may divert between 60 percent and 100 percent of the refrigerant discharging from the compressor 160 to the reheat coil 168.

Upon execution of the block 238 during a particular iteration of the process 230, the controller 204 may cycle through another iteration of the process 230. As such, it should be understood that the controller 204 may repeatedly iterate through any of the aforementioned steps of the process 230 to adjust operation of the condenser fan 170 and/or adjust the position of the reheat valve 164 in accordance with the techniques discussed herein.

As set forth above, embodiments of the present disclosure may provide one or more technical effects useful for eliminating or substantially mitigating undesired charge migration within a vapor compression system during dehumidification operations performed by an HVAC system. Specifically, the reheat control system disclosed herein may adjust operation of a condenser fan based on a position of a reheat valve to ensure that sufficient refrigerant is available in a reheat section of the vapor compression system to satisfy a refrigerant demand of the reheat coil. In this manner, the reheat control system may facilitate supply and delivery of dehumidified air to a building or other structure serviced by the HVAC system. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and air conditioning (HVAC) system, comprising:

a reheat valve configured to receive a refrigerant flow and regulate division of the refrigerant flow provided to a reheat coil and a condenser, wherein the reheat valve is configured to transition between a closed position and a plurality of open positions, wherein the reheat valve is configured to direct a first portion of the refrigerant flow to the reheat coil and to direct a second portion of the refrigerant flow to the condenser in each open position of the plurality of open positions;

a condenser fan configured to draw a flow of outdoor air across the condenser; and a controller communicatively coupled to the reheat valve and the condenser fan, wherein the controller is configured to:

monitor a position of the reheat valve; and block operation of the condenser fan in response to determining that the position of the reheat valve exceeds a threshold degree of opening.

2. The HVAC system of claim 1, wherein the reheat valve is configured to receive the refrigerant flow from a compressor of the HVAC system, wherein the first portion of the refrigerant flow comprises between 60 percent and 100 percent of the refrigerant flow received by the reheat valve while the position of the reheat valve exceeds the threshold degree of opening.

3. The HVAC system of claim 1, comprising a temperature sensor configured to provide the controller with feedback indicative of an ambient temperature surrounding the HVAC system, wherein the controller is configured to operate the condenser fan to draw the flow of outdoor air across the condenser in response to determining that:

the ambient temperature reaches or exceeds an upper threshold temperature; and the position of the reheat valve is below the threshold degree of opening.

4. The HVAC system of claim 3, wherein the controller is configured to block the operation of the condenser fan in response to determining that the ambient temperature falls below the upper threshold temperature by a threshold amount.

5. The HVAC system of claim 1, comprising a temperature sensor configured to provide the controller with feedback indicative of a temperature of a dehumidified air flow output by the reheat coil, wherein the controller is configured to compare the temperature to a reference temperature and to adjust the position of the reheat valve based on a difference between the temperature and the reference temperature.

6. The HVAC system of claim 5, comprising:

an evaporator disposed adjacent to the reheat coil and configured to receive a return air flow from a thermal load serviced by the HVAC system; and an additional temperature sensor configured to provide the controller with additional feedback indicative of an additional temperature of the return air flow or of air within the thermal load, wherein the reference temperature is the additional temperature.

7. The HVAC system of claim 5, comprising a user interface communicatively coupled to the controller, wherein the controller is configured to receive an input indicative of a target temperature setpoint for an interior of a thermal load serviced by the HVAC system via the user interface, and wherein the reference temperature is the target temperature setpoint.

8. The HVAC system of claim 1, wherein the reheat valve is a three-way valve adjustable between the closed position and the plurality of open positions to enable regulation of the division of the refrigerant flow between the reheat coil and the condenser, wherein the plurality of open positions comprises ten or more discrete positions.

9. A reheat control system for a heating, ventilation, and air conditioning (HVAC) system, comprising:

a reheat valve configured to receive a refrigerant flow and regulate division of the refrigerant flow provided to a reheat coil and a condenser, wherein the reheat valve is configured to transition between a closed position and a plurality of open positions, wherein the reheat valve is configured to direct a first portion of the refrigerant flow to the reheat coil and to direct a second portion of the refrigerant flow to the condenser in each open position of the plurality of open positions; and a controller configured to adjust a position of the reheat valve based on feedback from one or more sensors to achieve an operational parameter, to monitor the position of the reheat valve, and to block operation of a condenser fan of the condenser based on the position of the reheat valve exceeding a threshold degree of opening.

10. The reheat control system of claim 9, wherein the controller is configured to activate the condenser fan or enable the operation of the condenser fan in response to determining that the position of the reheat valve is less than the threshold degree of opening.

11. The reheat control system of claim 9, comprising a sensor of the one or more sensors, wherein the sensor is configured to acquire feedback indicative of a temperature of outdoor air surrounding the HVAC system, wherein the controller is configured to:

compare the temperature to an upper threshold temperature; and provide a signal to enable the operation of the condenser fan in response to determining that the temperature meets or exceeds the upper threshold temperature and the position of the reheat valve is less than the threshold degree of opening.

12. The reheat control system of claim 11, wherein the controller is configured to block the operation of the condenser fan in response to determining that the temperature of the outdoor air is less than the upper threshold temperature.

13. The reheat control system of claim 9, comprising:

the reheat coil;

a blower configured to direct an air flow across the reheat coil to enable the air flow to absorb thermal energy from the first portion of the refrigerant flow circulating through the reheat coil and to discharge the air flow from the reheat coil as a reheated air flow; and a sensor of the one or more sensors, wherein the sensor is configured to provide the controller with additional feedback indicative of a temperature of the reheated air flow, and wherein the controller is configured to adjust the position of the reheat valve based on the additional feedback.

14. The reheat control system of claim 9, wherein the reheat valve is configured to block the refrigerant flow through the reheat coil in the closed position.

15. The reheat control system of claim 9, wherein, at the threshold degree of opening, the reheat valve is configured to divert the first portion of the refrigerant flow such that between 60 percent and 80 percent of the refrigerant flow received at the reheat valve is directed to the reheat coil.

16. The reheat control system of claim 9, wherein the reheat valve is a three-way valve adjustable between the closed position and the plurality of open positions, wherein the plurality of open positions comprises ten or more discrete positions.

17. A method for operating a heating, ventilation, and air conditioning (HVAC) system, comprising:

adjusting, with a controller, a position of a reheat valve based on feedback from one or more sensors to control division of a refrigerant flow between a reheat coil and a condenser;

monitoring, with the controller, the position of the reheat valve to determine a degree of opening of the reheat valve; and blocking, with the controller, operation of a condenser fan of the condenser in response to a determination that the degree of opening of the reheat valve reaches or exceeds a threshold degree of opening.

18. The method of claim 17, comprising enabling, via the controller, the operation of the condenser fan in response to a second determination that the degree of opening of the reheat valve is less than the threshold degree of opening.

19. The method of claim 18, comprising:

monitoring, via the controller, a temperature of outdoor air surrounding the HVAC system;

comparing, via the controller, the temperature to an upper temperature threshold; and enabling, via the controller, the operation of the condenser fan in response to the second determination that the degree of opening of the reheat valve is less than the threshold degree of opening and a third determination that the temperature meets or exceeds the upper temperature threshold.

20. The method of claim 19, comprising blocking, via the controller, the operation of the condenser fan in response to a fourth determination that the temperature is less than the upper temperature threshold.

* * * * *